US007363767B2

(12) United States Patent
Wang

(10) Patent No.: US 7,363,767 B2
(45) Date of Patent: Apr. 29, 2008

(54) MULTI-STAGE PULSE TUBE CRYOCOOLER

(75) Inventor: Chao Wang, Syracuse, NY (US)

(73) Assignee: Cryomech, Inc., Syracuse, NY (US)

( * ) Notice: Subject to any disclaimer, the term of this patent is extended or adjusted under 35 U.S.C. 154(b) by 420 days.

(21) Appl. No.: 11/141,876

(22) Filed: Jun. 1, 2005

(65) Prior Publication Data

US 2005/0274124 A1 Dec. 15, 2005

Related U.S. Application Data

(60) Provisional application No. 60/579,800, filed on Jun. 15, 2004.

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 3,237,421 | A | 3/1966 | Gifford | 62/88 |
| 5,107,683 | A * | 4/1992 | Chan et al. | 62/6 |
| 5,295,355 | A | 3/1994 | Zhou et al. | 62/6 |
| 5,927,081 | A * | 7/1999 | Li | 62/6 |
| 6,378,312 | B1 | 4/2002 | Wang | 62/6 |
| 6,715,300 | B2 * | 4/2004 | Longsworth | 62/6 |
| 6,865,894 | B1 * | 3/2005 | Olson | 62/6 |
| 2003/0163996 | A1 | 9/2003 | Ravex | 62/6 |
| 2005/0223714 | A1 * | 10/2005 | Li et al. | 62/6 |

OTHER PUBLICATIONS

Wang, C.; Thummes, G. and C. Heiden, "Experimental Study of Staging Method for Two-Stage Pulse Tube Refrigerators for Liquid 4He Temperatures", Institute of Applied Physics, University of Giessen, D-35392 Giessen, Germany, 1997, vol. 37, No. 12, pp. 857-863.

* cited by examiner

*Primary Examiner*—William C Doerrler
(74) *Attorney, Agent, or Firm*—Brown & Michaels, PC

(57) ABSTRACT

A three-stage pulse-tube cryocooler, in which the third stage pulse tube is arranged below the second stage pulse tube, with a gas flow conduit between the second stage pulse tube heat exchanger and the cold end of the second stage regenerator. The design of the invention is much simpler than a conventional three-stage parallel pulse tube cooler, requiring only two pulse tubes at the warm (room temperature) end and two reservoirs, with a corresponding reduction in the number of associated orifices, passages, etc. In effect, this provides a three stage cryocooler with a two-stage warm end design by putting the second and third stage pulse tubes in series, with a gas flow passage providing gas flow between the second and third stages for gas expansion and refrigeration. The three-stage design allows an intermediate temperature connection between the temperatures of the first and third stages, for applications which require three cooling temperatures.

17 Claims, 1 Drawing Sheet

MULTI-STAGE PULSE TUBE CRYOCOOLER

REFERENCE TO RELATED APPLICATIONS

This application claims an invention which was disclosed in Provisional Application No. 60/579,800, filed Jun. 15, 2004, and entitled "Three-Stage Pulse Tube Cryocooler". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of cryorefrigeration. More particularly, the invention pertains to a multi-stage pulse tube cryocooler.

2. Description of Related Art

Typical closed-cycle regenerative cryocoolers include the Stirling, Gifford-McMahon and pulse tube types, all of which provide cooling through the alternating compression and expansion of a working fluid, with a consequent reduction of its temperature. Stirling and Gifford-McMahon regenerative cryocoolers use displacers to move a working fluid (usually helium) through their regenerators. The noise and vibration induced by the displacer creates problems, and the wear of the seals on the displacer require periodic maintenance and replacement.

Therefore, it is highly desirable to invent cryorefrigeration devices that generate less vibration and less acoustic noise than prior art cryocoolers. It is also desirable to decrease the number of moving parts used in cryorefrigeration devices and to significantly increase the required maintenance intervals and reliability. Pulse tube cryocoolers are a known alternative to the Stirling and Gifford-McMahon types, which differ from these in that pulse-tube cryocoolers do not use a mechanical displacer.

A pulse tube is essentially an adiabatic space wherein the temperature of the working fluid is stratified, such that one end of the tube is warmer than the other. A pulse tube cryocooler operates by cyclically compressing and expanding a working fluid in conjunction with its movement through heat exchangers. Heat is removed from the system upon the expansion of the working fluid in the gas phase.

As used herein, a "stage" in a cryocooler is a location in the cooler at which gas expansion and refrigeration occurs, and at which a thermal load may be attached at a "cooling station".

Prior art single-stage valved pulse tube cryocoolers generally include a pulse tube, a rotary valve to generate the oscillating compression-expansion cycle, a reservoir to contain the expanding working fluid gas, orifices for the movement and phasing of the gas between the reservoir or buffer volume and the rest of the system, and a regenerator for absorbing heat temporarily and reversibly. Single stage pulse tube cryocoolers are generally capable of reaching temperatures above 20K., and achieving lower temperatures has in the past required staging of the pulse tubes. U.S. Pat. No. 3,237,421 to Gifford and other prior art publications disclose multistage pulse tube cryocoolers. U.S. Pat. No. 5,295,355, a 1994 patent issued to Zhou, et al, shows a single-stage multi-bypass refrigerator.

Prior art two-stage pulse tube cryocoolers generally include, in addition to the foregoing components, a first-stage pulse tube, a first-stage regenerator, a second-stage pulse tube, a second-stage regenerator and first and second cooling stages. FIG. 2 of U.S. Pat. No. 6,378,312, issued to the present inventor, shows a two-stage cryocooler.

US Published application 2003/0163996 shows a cryocooler having two pulse tubes 108 and 120 and regenerator 106. A "heat intercept" 202 (FIG. 2) connects second stage pulse tube 120 and regenerator 106, but there is no flow passage in this connector. Because there is no gas passage, no gas expansion or refrigeration occurs at this point, so this invention is not a true "three stage" cooler, as the term is defined and used herein.

In a 1997 paper in *Cryogenics* (vol. 37, No. 12, pp. 857-863), entitled "Experimental study of staging method for two-stage pulse tube refrigerators for liquid $^4$He temperatures", the present inventor, plus Thummes and Heiden, described several embodiments of two-stage cryocoolers. The cooler shown in figure (c) is an attempt by the inventor to increase efficiency in the second stage by adding a gas bypass orifice between the second stage pulse tube and the second stage regenerator to control phasing of gas flow within the second stage. There is no heat exchanger at the location of the bypass, so that there is no cooling station located at this bypass, therefore this is a two-stage, not a three-stage cooler.

Three-stage cryocoolers are also known in the prior art which include all of the parts of a two-stage pulse tube cryocooler, plus a third reservoir, a third-stage regenerator, and a separate third-stage pulse tube in parallel with the first- and second-stage tubes.

SUMMARY OF THE INVENTION

The invention comprises a three-stage pulse-tube cryocooler, in which the third stage pulse tube is arranged below the second stage pulse tube, with a gas flow conduit between the second stage pulse tube heat exchanger and the cold end of the second stage regenerator. The design of the invention is much simpler than a conventional three-stage parallel pulse tube cooler, requiring only two pulse tubes at the warm (room temperature) end and two reservoirs, with a corresponding reduction in the number of associated orifices, passages, etc.

In effect, this provides a three stage cryocooler with a two-stage design by putting the second and third stage pulse tubes in series, with a gas flow passage providing gas flow between the second and third stages for gas expansion and refrigeration. The three-stage design allows an intermediate temperature connection between the temperatures of the first and third stages, for applications which require three cooling temperatures.

DETAILED DESCRIPTION OF THE INVENTION

Figure 1:
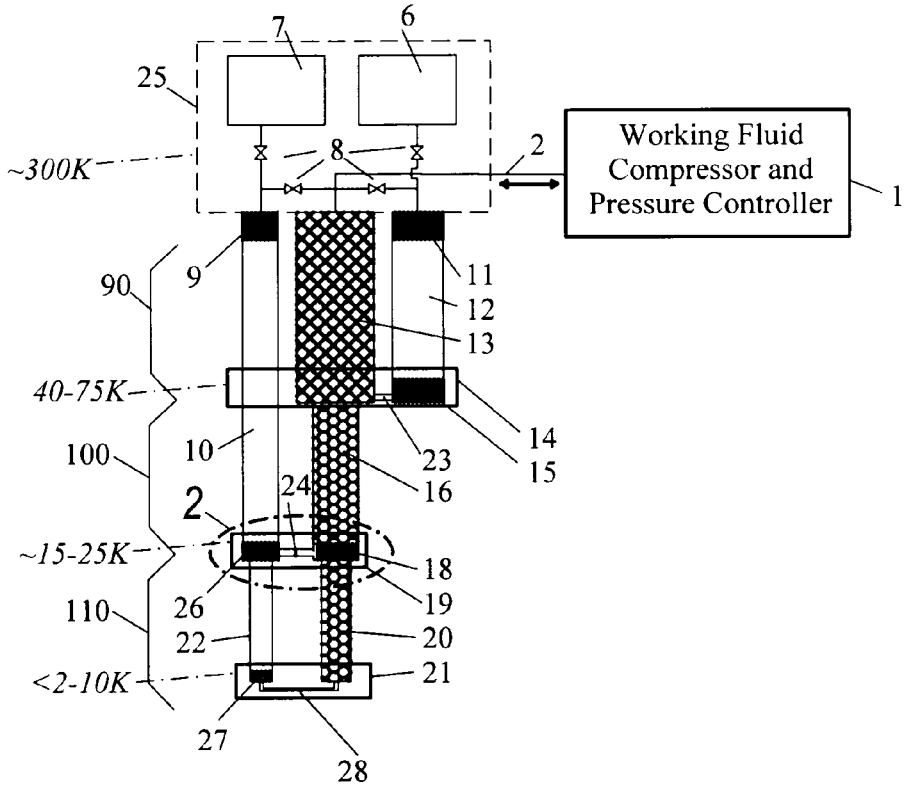
FIG. 1 shows a schematic diagram of a three-stage pulse-tube cryocooler of the invention.

A cryocooler is a heat pump that pumps heat from one or more cooling loads (not shown) to a heat sink, and thus to the ambient environment. Referring to FIG. 1, a three-stage cryorefrigeration apparatus of the invention includes a first cooling stage 90 and a second cooling stage 100. In prior art three-stage cryocoolers, the third stage pulse tube would be in parallel with the first two stages' pulse tubes.

In contrast, the third stage of the cryocooler of the invention adds a third stage 110, with its pulse tube 22 in series with the second stage pulse tube 10 (shown as underneath the second stage, in FIG. 1). Each stage cools to a lower temperature than the preceding stage, and cooling loads may be connected to one or more of cooling stations 14, 19 and 21, depending on the temperature required by the load. This provides a three stage cryocooler with two pulse tubes at the room temperature end by arranging the second- and third-stage pulse tubes in series, with gas flow passage 24 providing a passage for gas flow between the cold ends of the second stage regenerator 16 and the second stage pulse tube 10, thus causing gas expansion and refrigeration to occur at this stage.

As an example, in a cryocooler built according to the teachings of the invention, the first cooling stage 90 has a first stage temperature at the first stage cooling station 14 of between 40 K and 75 K, the second stage temperature of the second cooling stage 100 at the second stage cooling station 19 is about 15 K to 25 K, and the third cooling stage 110 has a third cooling stage temperature at the third cooling station 21 of about 2 K or less to 10 K. Of course, it will be understood by those skilled in the art that the exact temperature ranges given in this description and the drawing are for example, only, and the cooler could be built for other temperatures as would be required by the particular application in which the cooler will be employed. The cryocooler of the invention will be described in greater detail below.

FIG. 1 shows a "working fluid compressor and pressure controller" 1, providing an oscillating flow of working fluid 2 (for example, Helium) under pressure. It will be understood by one skilled in the art that the compressor/controller 1 could be a "Gifford-MacMahon (G-M) type" arrangement, in which a rotating valve alternately connects the cooler to a source of gas from a compressor and to an exhaust line back to the compressor. This causes an oscillating flow first from the compressor to the regenerator, then back from the regenerator to the exhaust. Typically, two gas-flow conduits would be provided from the compressor package, one for gas supply and one for exhaust. This arrangement is shown and explained in the inventor's U.S. Pat. No. 6,378,312, which is incorporated herein by reference. Alternatively, the compressor/controller 1 could be a "Stirling-type" valveless pressure wave generator, in which there is one conduit connecting the cooler to the compressor/controller, and the oscillating flow is in the form of pressure waves travelling back and forth along the single conduit.

One or more reservoirs (here shown as two reservoirs 6 and 7), flow channels and orifices 8, provide phasing of gas flows and connections to the pulse tubes and regenerators, as will be described in greater detail below.

The first-stage regenerator 13 is typically filled with a stack of screens which acts as a thermal sponge, alternately absorbing heat from the working fluid and rejecting the absorbed heat back to the working fluid as the pressure oscillates. First-stage pulse tube 12 is a thin-walled tube of a lower thermal conductivity material, such as stainless steel. If desired, a heat exchanger can be included at the cold end of the first stage regenerator, as is shown at 18 for the second stage regenerator.

First-stage pulse tube 12 has heat exchangers 11 and 15, preferably of copper, at its hot and cold ends, respectively. These are thermally coupled to the heat sink 25 and first stage cooling station 14, respectively, and may also act as flow straighteners for the gas flow in the pulse tube. Gas passage 23 connects the cold end of the first stage pulse tube 12 to the cold end of the first stage regenerator 13 through heat exchanger 15, providing the gas expansion and refrigeration for this stage. It should be noted here that while FIG. 1 shows the second stage pulse tube 10 passing through the first-stage cooling station 14, this is done for convenience of fabrication, and is not required. The first stage cooling station 14 may be made so as to avoid the second-stage pulse tube 10, or the second-stage pulse tube may be thermally isolated from the first-stage cooling station by making the hole through which it passes large enough to provide isolation, or by provision of insulation around the tube.

The second stage 100 of the cryocooler is made up of the second stage pulse tube 10 and second stage regenerator 16. Second-stage pulse tube 10 is connected at its hot end to the heat sink 25 and at its cold end to the second stage cooling station 19. Second-stage regenerator 16 is connected at its cold end to the second-stage cooling station 19, and at its hot end to the cold end of first-stage regenerator 13, for gas flow between the regenerators. The second stage pulse tube 10 and second-stage regenerator 16 are connected together at their cold ends by gas flow expansion passage 24, which allows gas flow between the second-stage pulse tube and second-stage regenerator for expansion and refrigeration at the second stage.

Optionally, the gas flow in passage 24 may be controlled by an orifice for restricting gas flow, as shown in FIG. 1.

FIGS. 2*a* through 2*d* show alternative embodiments of the gas passage 24 which might be used within the teachings of the invention. The area shown in these figures is the area of FIG. 1 enclosed in dot-dash oval labeled 2.

Figure 2A:
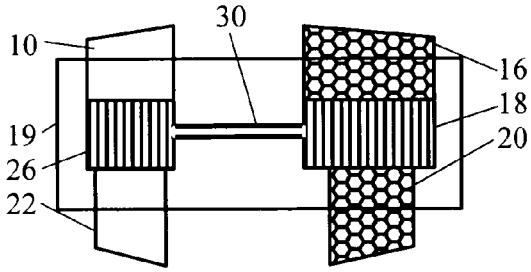
FIGS. 2*a*-2*d* show alternative embodiments of the gas passage, as a detail of the area from FIG. 1 enclosed in the dot-dash oval labeled 2.
Figure 2B:
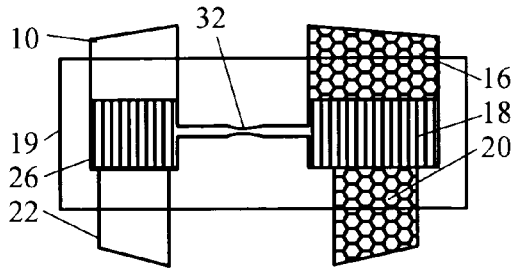
Figure 2C:
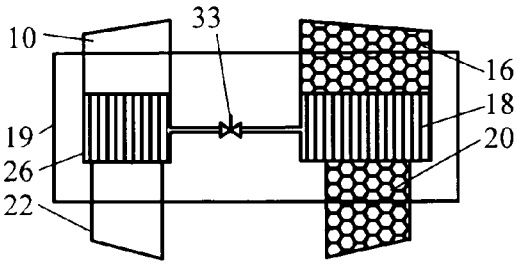
Figure 2D:
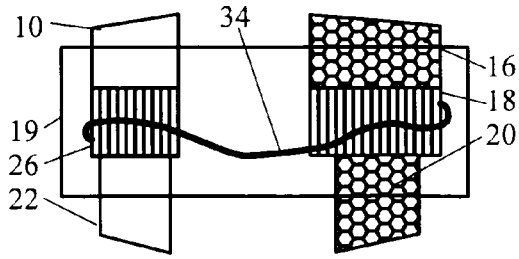

Three differing embodiments of the gas passage 24 having fixed configurations are a tube 30 (FIG. 2*a*), a constriction in the tube 32 (FIG. 2*b*), and a capillary tube 34 (FIG. 2*d*). Alternatively, a valve 33 (FIG. 2*c*) could be provided, which would allow adjustment of the gas passage 24.

As in first stage pulse tube 12, the hot end of the second stage pulse tube 10 preferably has a heat exchanger 9 at its hot end which is thermally coupled to heat sink 25, and (preferably) a heat exchanger 26 (possibly in the form of a screen region) at its cold end which is thermally coupled to the second stage cooling station 19. It is also possible to have a screen region at 26 which is not a heat exchanger (for example, being made of nylon), which acts as a flow straightener.

The second stage regenerator 16 is also filled with a regeneration material, such as the screens used in the first stage regenerator, or a lower-temperature material such as lead shot or rare-earth spheres as shown in U.S. Pat. No. 5,186,765. The second stage regenerator may also have a heat exchanger 18 at its cold end, coupled to the second stage cooling station 19. Either or both of heat exchangers 18 and 26 may be omitted if desired.

The second stage load is coupled to cooling station 19. It will be understood by one skilled in the art that the location of this connector, and the associated gas passage 24, will be determined by the desired temperature for this stage, between the temperatures of the first and third stages.

The third stage 110 of the cryocooler comprises the third stage pulse tube 22 and third stage regenerator 20. The third stage regenerator 20 may be filled with the same material as the second stage regenerator 16, or some other material having better low-temperature characteristics. The hot end of the third stage pulse tube 22 is directly below, and in gas communication with, the cold end heat exchanger 26 of the second stage pulse tube 17. The cold end of the third stage pulse tube may preferably have a heat exchanger 27 thermally coupled to the third stage cooling station 21. The hot end of the third stage regenerator 20 is directly below, and in gas communication with, the cold end of the second stage regenerator 16. The cold end of the third stage regenerator 20 is connected to the cold end of the third stage pulse tube 22 by passage 28. If desired, a heat exchanger can be included at the cold end of the third stage regenerator, as is shown at 18 for the second stage regenerator.

It will be understood that this could be extended to a four- or higher-stage design by the addition of more expansion passages like passage 24, with corresponding cooling stations.

In operation, compressor/controller 1 delivers an oscillating flow of working fluid 2 (usually helium), under pressure, to provide an alternating mass flow throughout the pulse tube cryocooler. The alternating pressure and mass flow produced by compressor/controller 1 constitutes pressure/volume (PV) work, causing regenerator 13 to pump heat from the cooling load to the heat sink 25, where the heat is ultimately rejected. The result of this heat pumping action is to lower the temperature of the cooling load. Meanwhile, the PV work travels down pulse tube 12, where it is rejected as heat to the heat sink 25. One or more reservoirs (shown in FIG. 1 as two reservoirs 6 and 7), through flow passages and orifices 8, provide phasing control for the gas flow.

The lower-temperature second-stage pulse tube 10 is in parallel with the first-stage pulse tube 12. In operation, compressor 1 supplies a continuous pressure wave to first stage regenerator 13. After providing cooling in the first-stage regenerator 13, the pressure wave provides further cooling in second-stage regenerator 16, with the cold end of second-stage pulse tube 10 and second-stage regenerator 16 being in thermal contact with a cooling load (not shown) at second stage cooling station 19. The pressure wave continues through passage 24 to the pulse tube 10, and the PV work is rejected as heat to the heat sink 25.

The lowest-temperature third-stage pulse tube 22 is connected in series with the cold end of second-stage pulse tube 10. After providing cooling in first-stage regenerator 13 and second-stage regenerator 16, the pressure wave provides further cooling in third-stage regenerator 20, with the cold end of third-stage pulse tube 22 and regenerator 20 in thermal contact with a cooling load (not shown) at third-stage cooling station 21. The pressure wave continues through passage 28 to third-stage pulse tube 22, and the PV work is ultimately rejected as heat to the second stage cooling station.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A three stage pulse-tube cryocooler comprising:

a first stage regenerator having a hot end thermally coupled to a heat sink and a cold end, the hot end being in fluid communication with an oscillating source of working fluid under pressure;

a first stage pulse tube having a hot end thermally coupled to the heat sink and a cold end with a first stage cold end heat exchanger thermally coupled to a first stage cooling station, the cold end of the first stage pulse tube being fluid coupled to the cold end of the first stage regenerator through the first stage cold end heat exchanger;

a second stage regenerator coupled for fluid flow in series with the first stage regenerator, having a hot end and a cold end;

a second stage pulse tube having a hot end thermally coupled to the heat sink and a cold end thermally coupled to a second stage cooling station;

a gas flow expansion passage providing a fluid coupling between the cold end of the second stage regenerator and the cold end of the second stage pulse tube;

a third stage regenerator coupled for fluid flow in series with the second stage regenerator, having a hot end and a cold end; and a third stage pulse tube coupled for fluid flow in series with the second stage pulse tube, having a hot end thermally coupled to the second stage cooling station and a cold end having a third stage cold end heat exchanger thermally coupled to a third stage cooling station, the cold end of the third stage pulse tube being fluid coupled to the cold end of the third stage regenerator through the third stage cold end heat exchanger.

2. The three-stage cryocooler of claim 1, in which fluid flow in the gas flow expansion passage is controlled by an orifice in the passage.

3. The three-stage cryocooler of claim 1, in which fluid flow in the gas flow expansion passage is controlled by a diameter restriction in the passage.

4. The three-stage cryocooler of claim 1, in which the gas flow expansion passage is a tube.

5. The three-stage cryocooler of claim 1, in which the gas flow expansion passage is a capillary tube.

6. The three-stage cryocooler of claim 1, in which fluid flow in the gas flow expansion passage is controlled by a valve in the passage.

7. The three-stage cryocooler of claim 1, further comprising a second stage pulse tube heat exchanger in the cold end of the second stage pulse tube, thermally coupled to the second stage cooling station.

8. The three-stage cryocooler of claim 7, in which the second stage pulse tube heat exchanger is a screen region.

9. The three-stage cryocooler of claim 1, further comprising a screen region flow straightener in the cold end of the second stage pulse tube.

10. The three-stage cryocooler of claim 1, further comprising a second stage regenerator heat exchanger in the cold end of the second stage regenerator, thermally coupled to the second stage cooling station.

11. The three-stage cryocooler of claim 1, further comprising a third stage regenerator heat exchanger in the cold end of the third stage regenerator, thermally coupled to the third stage cooling station.

12. The three-stage cryocooler of claim 1, further comprising a first stage regenerator heat exchanger in the cold end of the first stage regenerator, thermally coupled to the first stage cooling station.

13. The three-stage cryocooler of claim 1, further comprising a heat exchanger in the hot end of the second stage pulse tube, thermally coupled to the heat sink.

14. The three-stage cryocooler of claim 1, further comprising a reservoir fluid coupled to the hot end of the first pulse tube through an orifice.

15. The three-stage cryocooler of claim 1, further comprising a reservoir fluid coupled to the hot end of the second pulse tube through an orifice.

16. The three-stage cryocooler of claim 1, in which the source of working fluid comprises a fluid compressor having a fluid output for supplying fluid under pressure and a fluid exhaust for receiving fluid, the fluid output and fluid exhaust being coupled to a rotary valve, alternately applying working fluid under pressure from the fluid output of the compressor to the hot end of the first stage regenerator and withdrawing fluid from the hot end of the first stage regenerator back to the compressor through the fluid exhaust.

17. The three-stage cryocooler of claim 1, in which the source of working fluid comprises a Stirling-type valveless pressure wave generator having a fluid output for supplying fluid under oscillating pressure to the hot end of the first stage regenerator.

* * * * *